US008448557B2

(12) United States Patent
Hamish et al.

(10) Patent No.: US 8,448,557 B2
(45) Date of Patent: May 28, 2013

(54) FIRING MECHANISM SECURITY APPARATUS FOR REMOTELY CONTROLLED AUTOMATIC MACHINE GUN

(75) Inventors: Ran Hamish, Haifa (IL); Netanel Shapiro, Tzipori (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 67 days.

(21) Appl. No.: 13/151,302

(22) Filed: Jun. 2, 2011

(65) Prior Publication Data

US 2011/0296978 A1 Dec. 8, 2011

(51) Int. Cl.
*F41A 17/00* (2006.01)
*F41A 9/61* (2006.01)
*F41A 9/00* (2006.01)

(52) U.S. Cl.
USPC ..... 89/27.12

(58) Field of Classification Search
USPC ..... 89/27.12
See application file for complete search history.

(56) References Cited

U.S. PATENT DOCUMENTS

| | | | | |
|---|---|---|---|---|
| 4,470,351 | A * | 9/1984 | Farace | 102/232 |
| 4,796,532 | A * | 1/1989 | Webb | 102/233 |
| 4,869,172 | A * | 9/1989 | Webb | 102/233 |
| 6,769,347 | B1 * | 8/2004 | Quinn | 89/41.05 |
| 7,047,863 | B2 * | 5/2006 | Hawkes et al. | 89/37.04 |
| 2004/0134340 | A1 * | 7/2004 | Quinn | 89/41.01 |
| 2007/0051235 | A1 * | 3/2007 | Hawkes et al. | 89/37.04 |
| 2010/0281729 | A1 * | 11/2010 | Fu et al. | 42/1.14 |
| 2012/0279382 | A1 * | 11/2012 | Garrett et al. | 89/27.12 |

* cited by examiner

*Primary Examiner* — Michael David
(74) *Attorney, Agent, or Firm* — Mark M. Friedman

(57) ABSTRACT

A firing mechanism security apparatus prevents runaway machine gun fire by first sensing rounds being fired and sensing that the trigger mechanism is not instructing the weapon to fire. A mechanical actuator may block a path of the ammunition between the ammunition storage box and the machine gun or blocks spent ammunition from being ejected. Without engaging the trigger mechanism directly, a stopper signaled by a controller or motor may move from a first position to a second position and thereby be interposed between rounds of ammunition adjacent the ammunition storage box or between the ammunition feeder and the machine gun. The ammunition feeder may, alternatively, include a mechanical actuator that receives a signal from a motor or controller, the actuator capable of blocking the feeder's advancement of ammunition. Additionally, the gun may be elevated as a safety precaution.

13 Claims, 9 Drawing Sheets

FIRING MECHANISM SECURITY APPARATUS FOR REMOTELY CONTROLLED AUTOMATIC MACHINE GUN

FIELD AND BACKGROUND OF THE INVENTION

The present invention relates to preventing runaway fire from remotely controlled machine guns, and, more particularly to controlling such fire using mechanical intervention.

Weapon fire without the trigger pressed or after the trigger mechanism of the weapon is no longer being pressed, or is no longer instructing the weapon to fire, is a known problem. Control over the timing of weapon fire is a basic precondition to successful military operations and military training. The consequences of runaway weapon fire may include lethal damage to friendly combatants, waste of ammunition, revealing one's position to the enemy, etc. Although this problem is relevant to all types of weaponry, the consequences for remotely controlled machine gun fire may be particularly acute.

Runaway machine gun fire may be caused by inadequate tuning of the trigger mechanism prior to use of the weapon or simply by a failure of the weapon during its use.

There is a compelling need to have an apparatus that will prevent accidental fire from a remotely controlled machine gun that continues to fire after the trigger mechanism is no longer instructing the weapon to fire or that starts firing without the trigger mechanism being pressed.

SUMMARY OF THE PRESENT INVENTION

One aspect of the present invention is a firing mechanism security apparatus for an automatic machine gun, comprising a first sensor for sensing whether rounds are being fired by a remotely controlled automatic machine gun; a second sensor for sensing whether the automatic machine gun is being instructed to fire; and a mechanical actuator, upon receipt by the automatic machine gun of a signal that the first sensor senses rounds being fired at a time when the second sensor senses the automatic machine gun is not being instructed to fire, structured to interfere with advancement of ammunition in a path between an ammunition storage box and the machine gun.

A further aspect of the present invention is directed to a firing mechanism security apparatus for a remotely controlled automatic machine gun, comprising a first sensor for sensing whether rounds are being fired by the machine gun; a second sensor for sensing whether the machine gun is being instructed to fire; and an ammunition feeder that draws ammunition from an ammunition box and feeds ammunition to the machine gun, the ammunition feeder operatively engaged to a motor, the motor receiving an output from the first and second sensor such that the motor stops the ammunition feeder from drawing ammunition from the ammunition box and feeding the ammunition to the machine gun whenever the first sensor senses rounds being fired at a time that the second sensor senses the automatic machine gun is not being instructed to fire.

A still further aspect of the present invention is directed to a firing mechanism security apparatus for an automatic machine gun, comprising a first sensor for sensing whether at a set time rounds are being fired by a remotely controlled automatic machine gun; a second sensor for sensing whether at the set time the automatic machine gun is being instructed to fire; and a mechanical actuator that interferes with ejection of spent ammunition cartridges whenever the first sensor senses rounds being fired at a time when the second sensor senses the automatic machine gun is not instructed to fire.

A still further aspect of the present invention is a firing mechanism security apparatus for a remotely controlled automatic machine gun, the machine gun having a first sensor for sensing whether rounds are being fired by the machine gun and a second sensor for sensing whether the machine gun is being instructed to fire by a trigger mechanism, the firing mechanism security apparatus comprising an ammunition advancement mechanism that moves ammunition to the machine gun, the ammunition advancement mechanism including an ammunition storage box, a first ammunition advancement path between the ammunition storage box and an ammunition feeder, the ammunition feeder and a second ammunition advancement path between the ammunition feeder and the machine gun, the ammunition advancement mechanism including a mechanical actuator, the mechanical actuator, upon receipt by the machine gun of signals that the first sensor senses rounds being fired at a time and that the second sensor senses the automatic machine gun is not being instructed to fire, structured to interfere with the ammunition advancement mechanism by blocking advancement of ammunition between the ammunition storage box and the machine gun without directly engaging the trigger mechanism.

A further aspect of the present invention is directed to a method of controlling unwanted fire from a remotely controlled machine gun, comprising sensing whether the machine gun is firing rounds; sensing whether the machine gun is receiving an instruction to fire; a controller determining whether it is the case that the machine gun is firing rounds and not receiving instructions to fire; sending a signal to a mechanical actuator to interfere with advancement of ammunition rounds in a path from an ammunition storage box to an ammunition feeder or from the ammunition feeder to the machine gun; and interfering with advancement of the ammunition rounds so as to terminate the unwanted fire.

These and other features, aspects and advantages of the present invention will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE INVENTION

Figure 1:
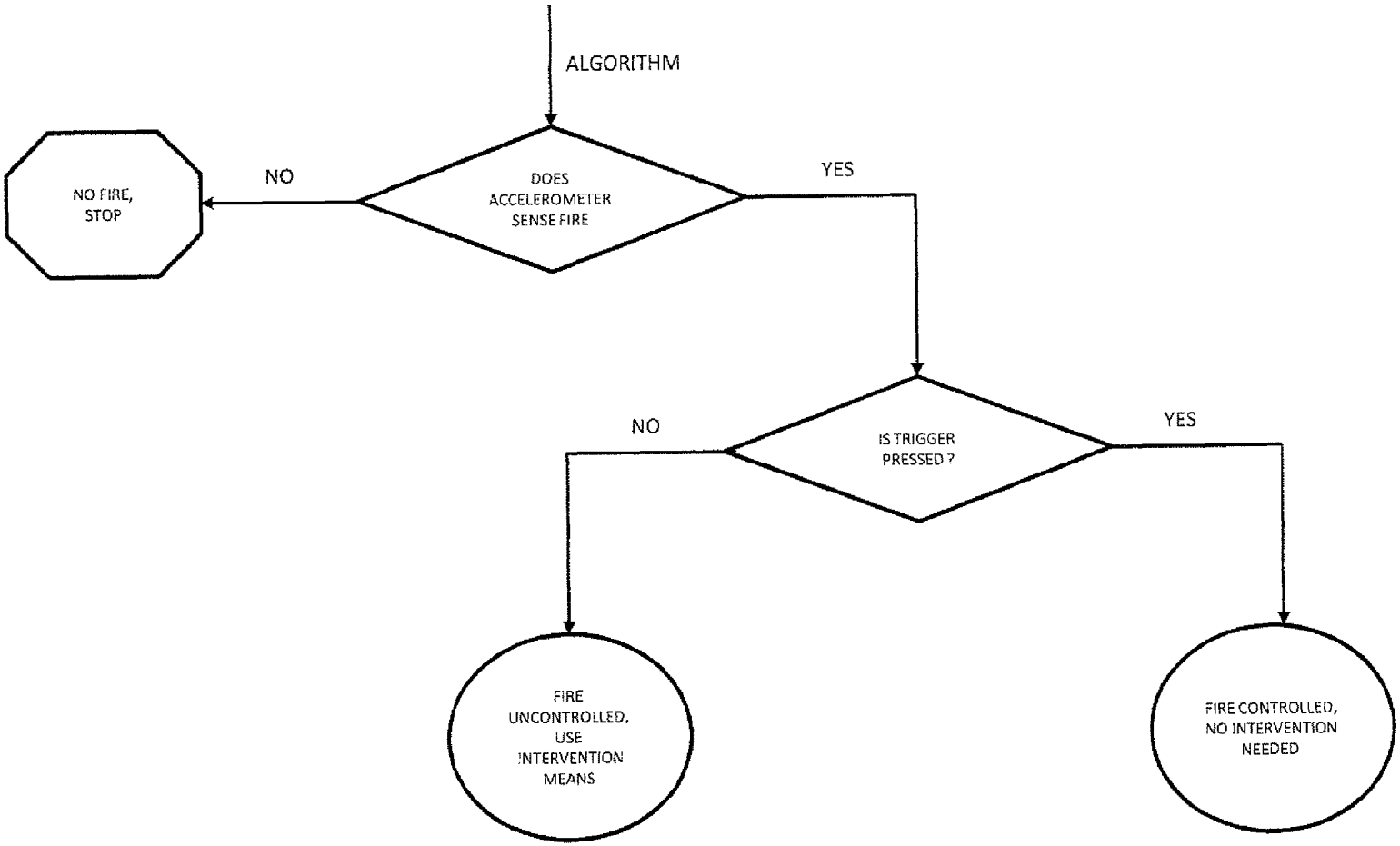
FIG. 1 is a flow chart showing an algorithm of a firing mechanism security apparatus in accordance with one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides a remotely controlled machine gun that may have an electromechanical mechanism for preventing runaway machine gun fire. A mechanical actuator may be situated along a path of ammunition. For example, a stopper may be positioned adjacent the ammunition box, in the ammunition feeder, between the ammunition feeder and the machine gun. The trigger mechanism may not be affected directly. Alternatively, the stopper may be structured to block the spent ammunition ejection mechanism. The firing mechanism security apparatus may also include an electromechanical mechanism for elevating the barrel of the machine gun. When a controller or motor receives signals from sensors sensing runaway fire in the machine gun, the controller or motor may signal a mechanical actuator to move from one position to a second position so that a path of the ammunition rounds is blocked from advancement to the machine gun from the ammunition storage box.

In contrast to the prior art machine guns in which there is a danger that the machine gun can continue firing even after the trigger is no longer pressed, the machine gun of the present invention may have a safeguard mechanism that prevents such runaway fire. In contrast to the prior art safety mechanisms that try to prevent actuation of a trigger upon receipt of a signal, the firing mechanism security apparatus of the present invention may operate without having to engage the trigger mechanism. In further contrast to the prior art, in which mechanism for stopping accidental fire by an automatic firearm may involve preventing the trigger mechanism from being actuated, the control mechanism of the present invention may be operatively engaged to the ammunition advancement mechanism of the machine gun. By being independent of the firing mechanism, the firing mechanism security apparatus of the present invention can be implemented with weaponry of a wide variety of firing mechanisms, including regular automatic machine guns, remotely controlled automatic machine gun, and semi-automatic machine guns. In still further contrast to the prior art weapon safety control mechanisms in which the mechanism may prevent unwanted actuation of a firing mechanism but cannot successfully shut down the firing mechanism once the unwanted fire has already occurred, the firing mechanism security apparatus of the present invention may be able to block unwanted fire once the unwanted fire from the machine gun is already occurring. In contrast to the prior art, in which the firing safety mechanism may not be able to thwart unwanted firing by a machine gun whether caused by inadequate tuning of the trigger mechanism prior to use of the weapon or simply by a failure of the weapon during its use, the firing mechanism security apparatus of the present invention may be able to shut down unwanted machine gun fire regardless of its cause. In still further contrast to the prior art, in which a safety mechanism for preventing unwanted weapon fire may be limited, the safety mechanism of the present invention may include not only a capability of blocking the ammunition path but also of increasing the angle of elevation of the barrel. In contrast to the prior art, in which safety mechanisms may operate alone or singly, the firing mechanism security apparatus of the present invention may also incorporate an additional safety feature of setting the stopper to a default position in which it blocks advancement of the ammunition normally whenever the automatic machine gun is not being instructed to fire.

The principles and operation of a method and system for a firing mechanism security apparatus for a remotely controlled automatic machine gun according to the present invention may be better understood with reference to the drawings and the accompanying description.

As seen from the flowchart of FIG. 1, the algorithm used by an apparatus 10 of the present invention may first inquire whether rounds of ammunition are being fired by the machine gun 70. They may be a determination as to whether a first sensor 20 senses accelerating projection of ammunition rounds. This may be accomplished by a conventional sensor that counts rounds of ammunition. Alternatively, this may be accomplished by a first sensor integrated into the machine gun's firing mechanism such that it can assess either the actual passing of ammunition rounds past a certain point or the actual speed or acceleration of ammunition rounds. If the first sensor senses live fire, the protection mechanism of the algorithm need not be used further. If, however, the first sensor senses firing of live ammunition, a further inquiry is made by the second sensor 30. The second sensor 30 senses whether the trigger of the machine gun 70 is still being pressed. More generally, for automatic machine guns 70 that may be remotely controlled, second sensor senses whether the machine gun is receiving instructions to fire. If the answer is yes, then nothing further need be done since the output of the first sensor is consistent with the output of the second sensor. However, if the inquiry by the second sensor has a "no" output, and the machine gun is no longer being instructed to fire, and this is at a time when the first sensor senses the firing of live ammunition, the interference protection mechanism may be actuated.

As shown in FIG. 2, FIG. 3, FIG. 4 and FIG. 5, there are at least four embodiments of the mechanism of interfering with advancement of the ammunition in accordance with the present invention. In many of these embodiments the firing mechanism security apparatus may further include a mechanical actuator 40. Mechanical actuator 40 may be structured to interfere with the advancement of the ammunition 50 at one or more points along a path of the ammunition between the ammunition storage box 60 and the machine gun 70, a path which may include an ammunition feeder 80.

Mechanical actuator 40 may be set up to accomplish such interference upon receipt by the automatic machine gun of a signal that the first sensor 20 senses rounds being fired at a time when the second sensor 20 senses the automatic machine gun is not being instructed to fire.

Figure 2:
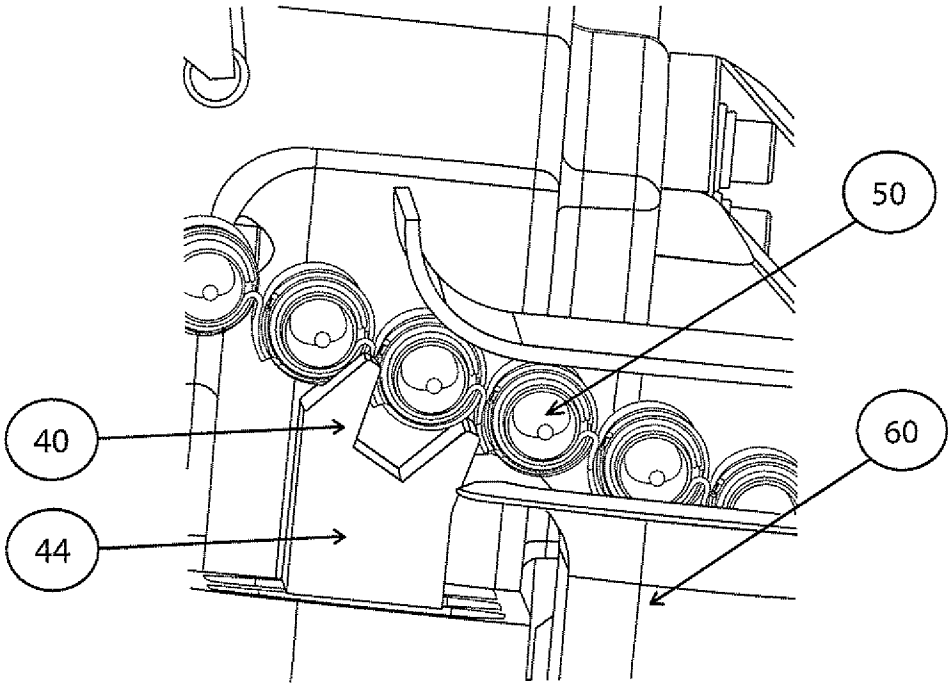
FIG. 2 is a photograph of part of a firing mechanism security apparatus in accordance with one embodiment of the present invention.
Figure 7:
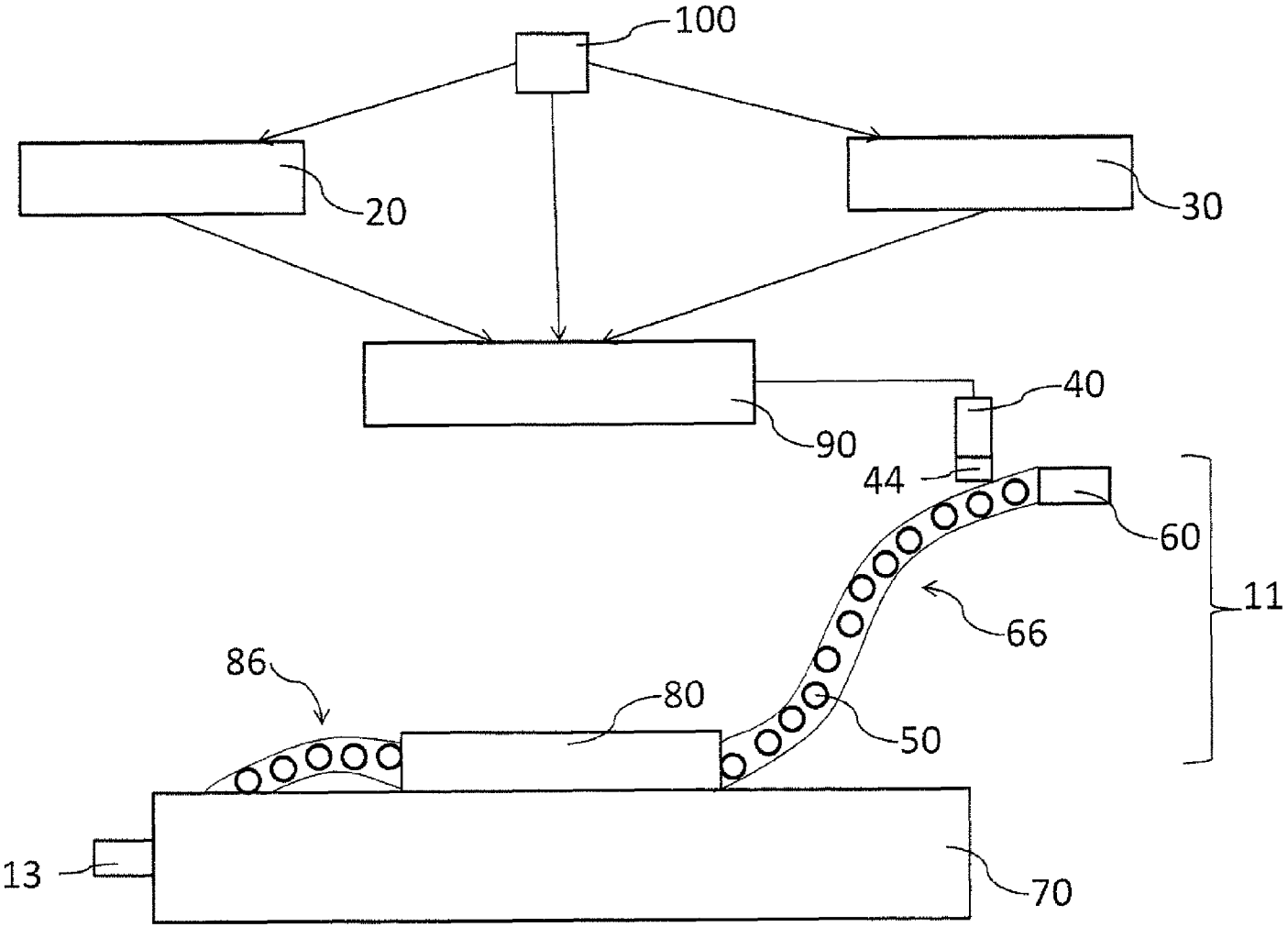
FIG. 7 is a schematic depicting an apparatus in accordance with one embodiment of the present invention using a mechanism similar to that shown in FIG. 2.

For example, as shown in FIG. 2 and in FIG. 7, mechanical actuator 40 may be structured so as to be capable of interfering with the advancement of ammunition 50 from when ammunition 50 leaves an ammunition storage box 60 to when ammunition 50 enters an ammunition feeder 80. For example, mechanical actuator 40 may be adjacent ammunition storage box 60 and may be capable of interfering with advancement of ammunition 50 as the ammunition 50 leaves ammunition storage box 60.

As seen in FIG. 2, mechanical actuator 40 may include a stopper 44 adjacent ammunition storage box 60. Stopper 44 may have a first position that does not interfere with advancement of the ammunition and a second position that may block advancement of the ammunition. As a further safeguard, stopper 44 may be situated in the second position whenever second sensor 30 senses the automatic machine gun 70 is not being instructed to fire. Alternatively, stopper 44 may be set in the second position as the "normal" position until an action is taken by the user to move stopper 44 to its first position allowing advancement of ammunition 50. As seen in FIG. 2, stopper 44 may intervene between rounds of ammunition 50 when stopper 44 is in its second position.

Figure 3:
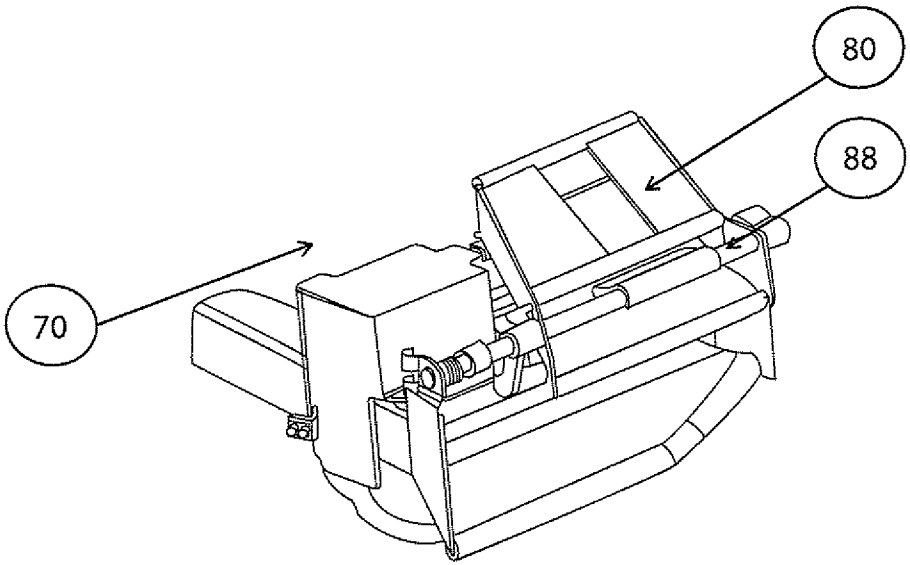
FIG. 3 is a photograph of part of a firing mechanism security apparatus, in accordance with a further embodiment of the present invention.
Figure 6:
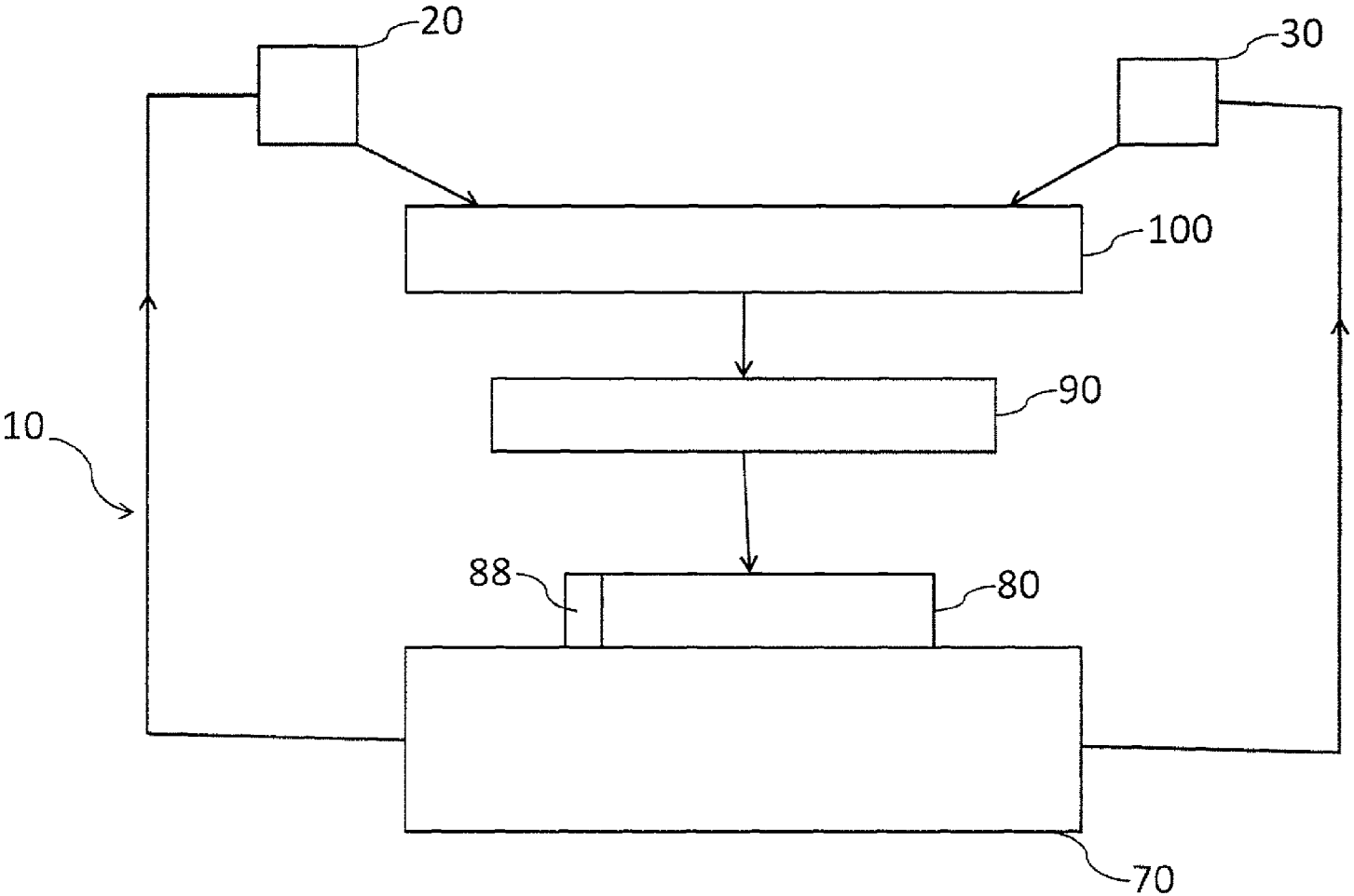
FIG. 6 is a schematic depicting an apparatus in accordance with one embodiment of the present invention using a mechanism similar to that shown in FIG. 3.

In a further embodiment shown in FIG. 3, mechanical actuator 40 may be structured so as to be capable of interfering with advancement of the ammunition 50 when ammunition 50 is in ammunition feeder 80. For example, ammunition feeder 80 may draw ammunition 50 from ammunition storage box 60 and may feed ammunition 50 to machine gun 70, the ammunition feeder 80 may be operatively engaged to a motor 90. As shown in FIG. 6, which uses a mechanism similar to that shown in FIG. 3, motor 90 may receive an output from the first sensor 20 and second sensor 30 such that motor 90 may stop ammunition feeder 80 from drawing ammunition 50 from ammunition storage box 60 and feeding ammunition 50 to machine gun 70 whenever first sensor 20 senses rounds being fired at a time that second sensor 30 senses automatic machine gun 70 is not being instructed to fire. The term "motor" includes any electromechanical mechanism that generates an output of mechanical motion by mechanical actuator 40. Besides a conventional motor that receives input of electrical signals, motor 90 may be a device whose input may be electromagnetic or electrochemical or other forms of energy.

As shown in FIG. 3 and in FIG. 6, ammunition feeder 80 may include a rotatable axle 88 that may actuate ammunition feeder 80 to draw ammunition 50 from storage box 60 and feed ammunition 50 to machine gun 70. Rotatable axle 88 may be operatively engaged to motor 90. Motor 90 may receive an output from the first and second sensors 20, 30 such that motor 90 may stop rotation of rotatable axle 88 whenever first sensor 20 senses rounds being fired at a time that second sensor 30 senses automatic machine gun 70 is not being instructed to fire.

As seen in FIG. 6, firing mechanism security apparatus 10 may also include a controller 100 that may be operationally engaged to motor 90 and to the first sensor 20 and second sensor 30. For example, controller 100 may receive output signals from sensors 20, 30 and when these signals indicate that rounds are being fired but machine gun 70 is receiving no instruction to fire rounds then controller 100 may instruct motor 90 to stop ammunition feeder 80 from drawing ammunition 50 from ammunition storage box 60 and feeding ammunition 50 to machine gun 70. Alternatively, controller 100 may receive output signals from sensors 20, 30 and when these signals indicate that rounds are being fired but machine gun 70 is receiving no instruction to fire rounds then controller 100 may instruct a motor 90 operatively engaged to mechanical actuator 40 to instruct mechanical actuator 40 to move to second position in which it blocks advancement of ammunition 50, as in FIG. 2.

Figure 4:
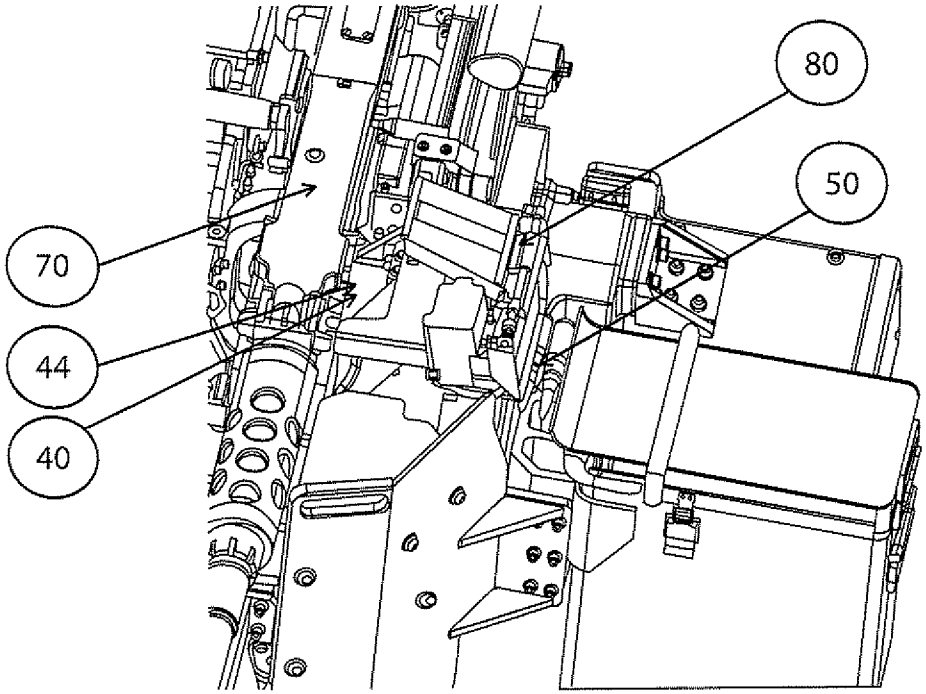
FIG. 4 is a photograph of part of a firing mechanism security apparatus, in accordance with a still further embodiment of the present invention.

In a further embodiment shown in FIG. 4, mechanical actuator 40 may be structured so as to be capable of interfering with advancement of the ammunition when the ammunition is between the ammunition feeder 80 and the machine gun 70. Stopper 44 may have a first position that does not interfere with advancement of the ammunition and a second position that may block advancement of the ammunition. Stopper 44 may for example interfere with advancement of ammunition 50 in its second position by being inserted between advancing ammunition 50.

Figure 9:
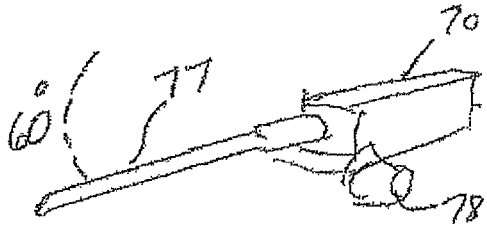
FIG. 9 is a schematic depicting an elevation mechanism for the firing mechanism security system.

In any embodiment, as shown in FIG. 9, firing mechanism security system 10 may operate in tandem with other security mechanisms for controlled runaway fire, such as an elevation mechanism. For example, machine gun 70 may include an elevation mechanism for increasing an angle of elevation between a barrel 77 of machine gun 70 and a horizontal plane whenever first sensor 20 senses rounds being fired at a time when second sensor 30 senses the automatic machine gun 70 is not being instructed to fire. The elevation mechanism may for example increase the angle of elevation approximately 60 rotational degrees to avoid runaway machine gun fire causing damage to surrounding people or structures. For example, an elevation rotation axis 78 of the elevation mechanism may receive an input from controller 100 or motor 90 that sensors 20, 30 sense runaway machine gun fire as per the algorithm shown in FIG. 1 and may rotate machine gun 70 including barrel 77 approximately 60 rotational degrees upward.

Figure 5:
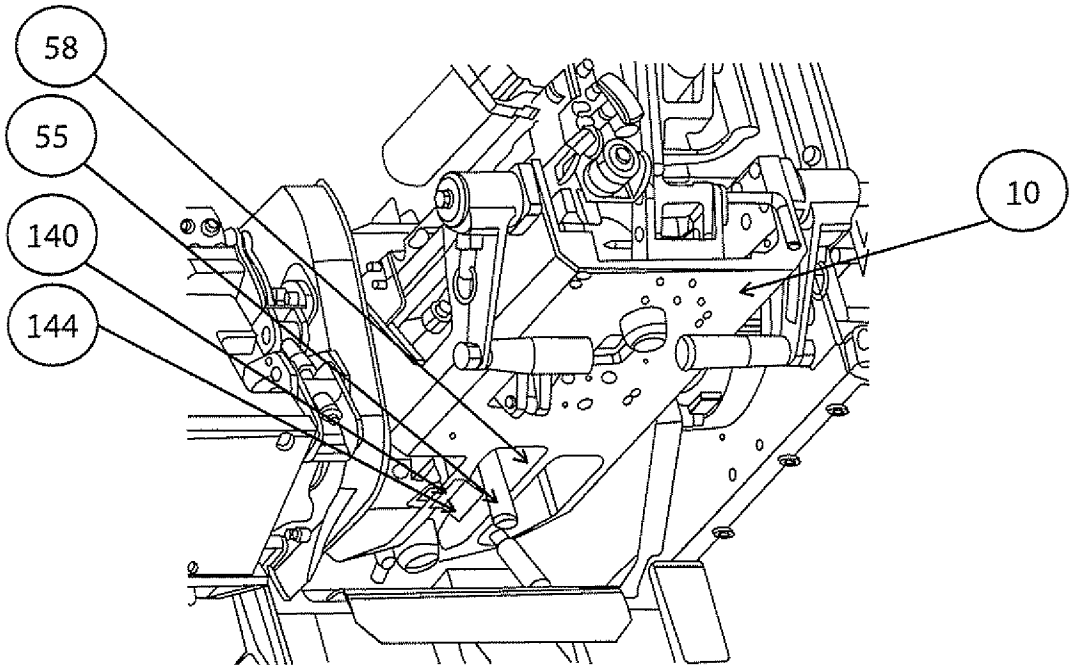
FIG. 5 is a photograph of part of a firing mechanism security apparatus, in accordance with a still further embodiment of the present invention.

In a further embodiment, firing mechanism security apparatus 10 may comprise first sensor 20 for sensing whether at a set time rounds are being fired by a remotely controlled automatic machine gun, second sensor 30 for sensing whether at the set time the automatic machine gun 70 is being instructed to fire. As shown in FIG. 5, apparatus 10 may further comprise mechanical actuator 140 that may interfere with ejection of spent ammunition cartridge 55 whenever first sensor 20 senses rounds being fired at a time when the second sensor 30 senses the automatic machine gun 70 is not instructed to fire. "Spent ammunition cartridge" refers to the cartridge case that is ejected when rounds are fired.

As seen in FIG. 5, mechanical actuator 140 may include a stopper 144 that may block a path of spent ammunition cartridge 55 from exiting an ammunition ejection outlet 58 of machine gun 70. Stopper 144 may have a first position that allows advancement of the spent ammunition cartridge 55 and a second position that blocks advancement of the spent ammunition cartridge 55 in the path during which spent ammunition cartridge 55 goes through ejection outlet 58. As seen from FIG. 5, for example, stopper 144 may plug a lower portion of the ejection outlet 58.

The present invention may also be characterized as a firing mechanism security apparatus for a remotely controlled automatic machine gun, the machine gun having a first sensor for sensing whether rounds are being fired by the machine gun and a second sensor for sensing whether the machine gun is being instructed to fire by a trigger mechanism. In this case, the firing mechanism security apparatus 10 may comprise an ammunition advancement mechanism 11 (see FIG. 7) that may move ammunition cartridge 55 to machine gun 70. As seen from FIG. 7, ammunition advancement mechanism 11 may include an ammunition storage box 60, a first ammunition advancement path 66 between the ammunition storage box 60 and an ammunition feeder 80, the ammunition feeder 80 and a second ammunition advancement path 86 between the ammunition feeder 80 and the machine gun 70.

Ammunition advancement mechanism 11 may include a mechanical actuator 40 that upon receipt by the machine gun 70 of signals that first sensor 20 senses rounds being fired at a time and that the second sensor 30 senses the automatic machine gun 70 is not being instructed to fire, structured to interfere with the ammunition advancement mechanism by blocking advancement of ammunition between the ammunition storage box 60 and machine gun 70. Ammunition advancement mechanism 11 may operate without being operatively engaged to the trigger 13 or firing mechanism 13 of machine gun 70. Mechanical actuator 40 may for example include a stopper 44 capable of being inserted between rounds of ammunition.

Figure 8:
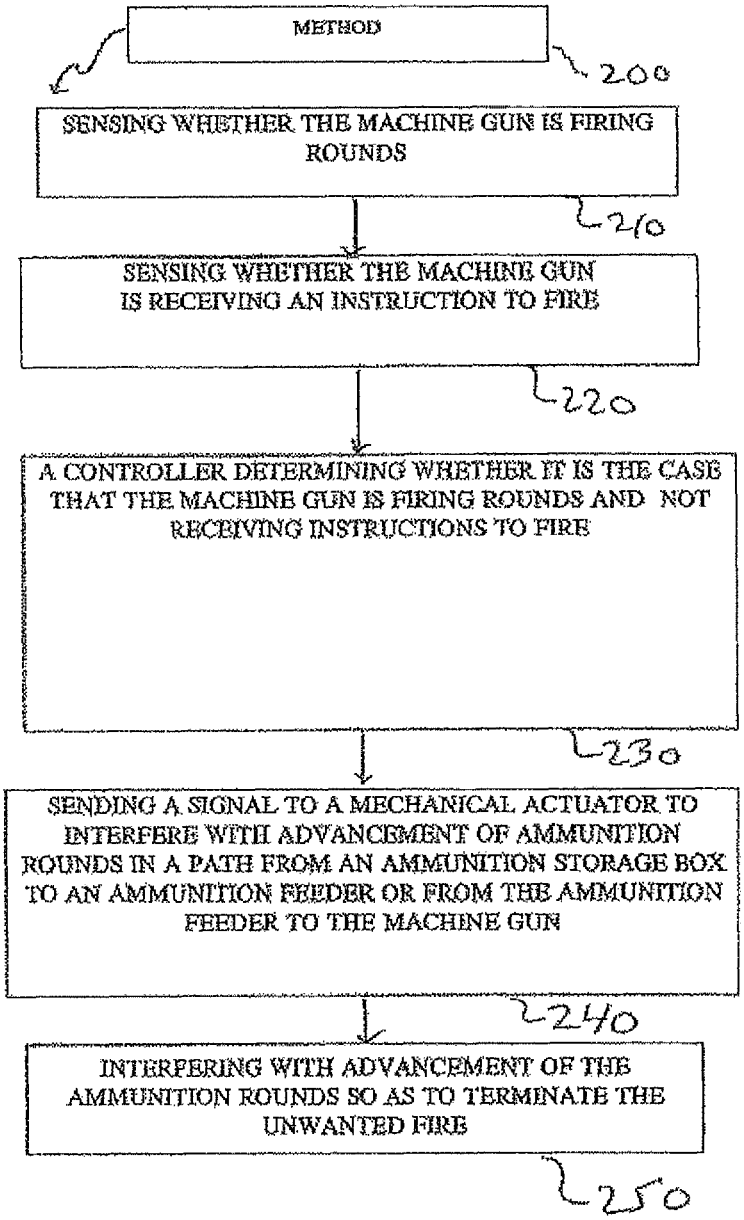
FIG. 8 is a flow chart showing a method of the present invention.

As shown in FIG. 8, the present invention may also be characterized as a method 200 of controlling unwanted fire from a remotely controlled machine gun. Method 200 may include a first step 210 of sensing whether the machine gun is firing rounds and a second step 220 of sensing whether the machine gun is receiving an instruction to fire. The output of these sensors having been fed to a controller, method 200 may also comprise a step 230 of the controller 100 determining whether it is the case that the machine gun is firing rounds and not receiving instructions to fire. Method 200 may include a further step 240 of sending a signal to a mechanical actuator 40 to interfere with advancement of ammunition rounds 50 in a path from an ammunition storage box 60 to an ammunition feeder 80 or from the ammunition feeder 80 to the machine gun 70. Finally, method 200 may include a step 250 of interfering with advancement of the ammunition rounds so as to terminate the unwanted fire.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A firing mechanism security apparatus for an automatic machine gun, comprising:

a first sensor for sensing whether rounds are being fired by a remotely controlled automatic machine gun;

a second sensor for sensing whether the automatic machine gun is being instructed to fire; and a mechanical actuator, upon receipt by the automatic machine gun of a signal that the first sensor senses rounds being fired at a time when the second sensor senses the automatic machine gun is not being instructed to fire, structured to interfere with advancement of ammunition in a path between an ammunition storage box and the machine gun.

2. The firing mechanism security apparatus of claim 1, wherein the mechanical actuator is either capable of interfering with advancement of ammunition from when the ammunition leaves the ammunition storage box to when the ammunition enters an ammunition feeder, capable of interfering with advancement of the ammunition when the ammunition is in the ammunition feeder, or is capable of interfering with advancement of the ammunition when the ammunition is between the feeder and the machine gun.

3. The firing mechanism security apparatus of claim 2, wherein the mechanical actuator is capable of interfering with the advancement of ammunition when the ammunition is in the ammunition feeder.

4. The firing mechanism security apparatus of claim 3, wherein the mechanical actuator is capable of interfering with the advancement of ammunition when the ammunition is in the ammunition feeder by stopping the ammunition feeder from drawing ammunition from the ammunition storage box.

5. The firing mechanism security apparatus of claim 3, wherein the mechanical actuator is capable of interfering with the advancement of ammunition when the ammunition advances through the ammunition feeder.

6. The firing mechanism security apparatus of claim 1, wherein the mechanical actuator is adjacent the ammunition storage box and is capable of interfering with advancement of ammunition as the ammunition leaves the ammunition storage box.

7. The firing mechanism security apparatus of claim 1, wherein the mechanical actuator includes a stopper adjacent the ammunition storage box, the stopper having a first position that allows advancement of the ammunition and a second position that blocks advancement of the ammunition.

8. The firing mechanism security apparatus of claim 7, wherein the stopper is situated in the second position unless the stopper is moved to the first position.

9. The firing mechanism security apparatus of claim 1, wherein the mechanical actuator includes a stopper having a first position that allows advancement of the ammunition and a second position that blocks advancement of the ammunition.

10. The firing mechanism security apparatus of claim 9, wherein the stopper is situated in the second position whenever the second sensor senses the automatic machine gun is not being instructed to fire.

11. The firing mechanism security apparatus of claim 1, wherein the mechanical actuator is capable of interfering with advancement of the ammunition in a path between the ammunition feeder and the machine gun.

12. The firing mechanism security apparatus of claim 1, further including an elevation mechanism for increasing an angle of elevation between a barrel of the machine gun and a horizontal plane whenever the first sensor senses rounds being fired at a time when the second sensor senses the automatic machine gun is not being instructed to fire.

13. The firing mechanism security apparatus of claim 12, wherein the elevation mechanism is capable of increasing the angle of elevation approximately 60 rotational degrees.

* * * * *

UNITED STATES PATENT AND TRADEMARK OFFICE

CERTIFICATE OF CORRECTION

PATENT NO. : 8,448,557 B2
APPLICATION NO. : 13/151302
DATED : May 28, 2013
INVENTOR(S) : Ran Hamish et al.

It is certified that error appears in the above-identified patent and that said Letters Patent is hereby corrected as shown below:

Title Page, Item (30) Foreign Application Priority data should be added as follows:

"Jun. 2, 2010 (IL) ..... 206142".

Signed and Sealed this
Twenty-third Day of July, 2013

Teresa Stanek Rea
*Acting Director of the United States Patent and Trademark Office*